US006799403B2

(12) United States Patent
Winter

(10) Patent No.: US 6,799,403 B2
(45) Date of Patent: Oct. 5, 2004

(54) DEEP-RIBBED, LOAD-BEARING, PREFABRICATED INSULATIVE PANEL AND METHOD FOR JOINING

(76) Inventor: Teresa G. Winter, 136 Pinnacle Springs Rd., Chesterfield, NH (US) 03443

( * ) Notice: Subject to any disclaimer, the term of this patent is extended or adjusted under 35 U.S.C. 154(b) by 0 days.

(21) Appl. No.: 09/847,657

(22) Filed: May 2, 2001

(65) Prior Publication Data

US 2002/0020129 A1 Feb. 21, 2002

Related U.S. Application Data

(60) Provisional application No. 60/202,523, filed on May 6, 2000.

(51) Int. Cl.[7] ..... E04B 5/00

(52) U.S. Cl. ..... 52/406.1; 52/309.8; 52/586.1; 52/581

(58) Field of Search ..... 52/309.8, 537, 52/309.4, 79.1, 406.1, 586.1, 585.1, 581, 583.1

(56) References Cited

U.S. PATENT DOCUMENTS 2,728,702 A * 12/1955 Simon et al. ..... 156/242
2,991,855 A * 7/1961 Buell et al. ..... 189/34
3,038,573 A * 6/1962 Nuernberger ..... 189/88
3,208,189 A * 9/1965 Hickman ..... 52/310
3,290,845 A * 12/1966 Snyder ..... 52/478
3,973,366 A * 8/1976 Balane et al. ..... 174/48
4,295,304 A * 10/1981 Kim ..... 52/309.9
4,936,071 A * 6/1990 Karrfalt ..... 52/420
5,088,259 A * 2/1992 Myers ..... 52/309.8
5,600,929 A * 2/1997 Morris ..... 52/309.8
5,855,101 A * 1/1999 Schulte et al. ..... 52/506.05
6,119,422 A * 9/2000 Clear et al. ..... 52/268

* cited by examiner

*Primary Examiner*—Carl D. Friedman
*Assistant Examiner*—Basil Katcheves

(57) ABSTRACT

A prefabricated structural building panel having a deep ribbed sheet metal interior skin. The panel preferably has a light weight rigid highly insulative foam core bonded to inner and outer skins, and having a ribbed configuration for the interior skin. A method for building a structural wall by assembling panels in an edge to edge relationship to create a structural wall system with the ribbed interior skin providing the structural support. A prefabricated insulated structural panel, having a core material of various types of foam plastic bonded to an interior ribbed metal skin and an exterior skin of any one or combination of suitable exterior materials such as for example wood, fiber glass, cement, or metal. The edges of the panels are configured to abuttingly match corresponding edges of similarly configured panels when such panels are arranged in edge to edge relationship to form the structure wall of a building. The interior ribbed metal skin, when bonded to a foam core, the foam core being continuous and completely within the cavities or the valleys of the ribbed panel, and an outer skin bonded to the outer surface of the foam core, all combine to form a structural panel in which the ribbed interior skin will support substantially the entire axial load and the composite panel will support all the live or wind load to which it would be subjected.

10 Claims, 6 Drawing Sheets

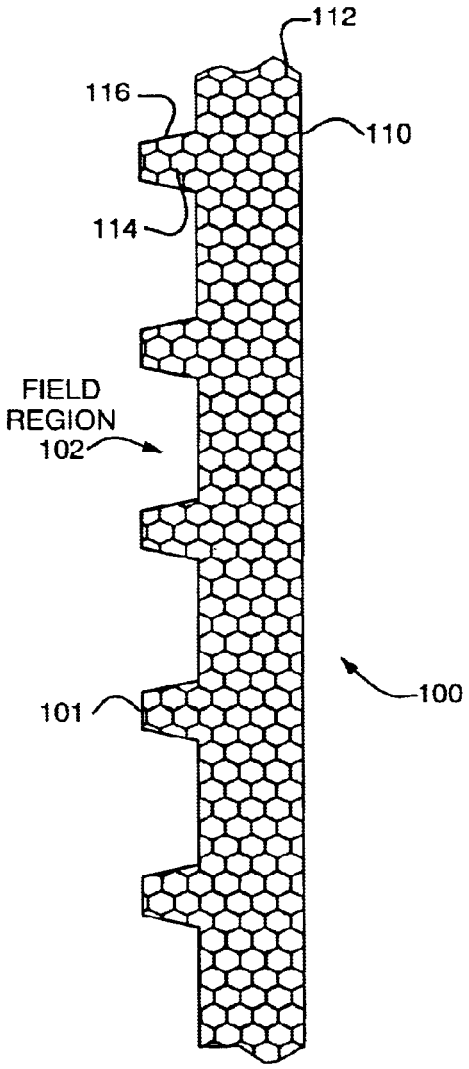
FIG. 1
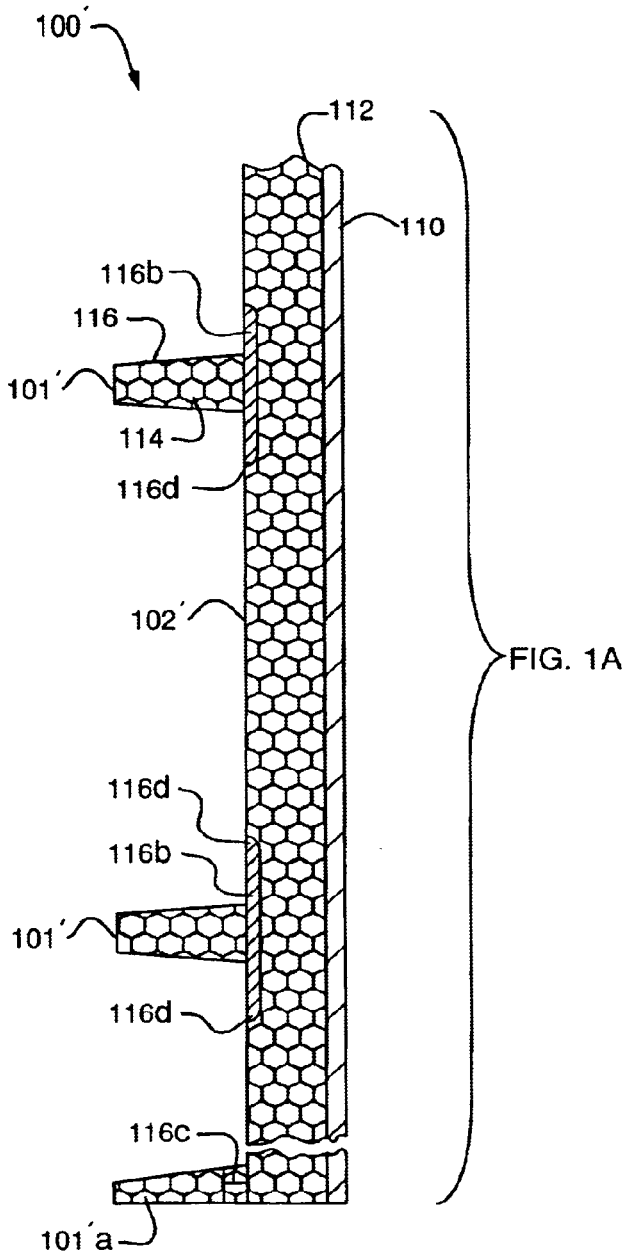

DEEP-RIBBED, LOAD-BEARING, PREFABRICATED INSULATIVE PANEL AND METHOD FOR JOINING

CROSS-REFERENCE TO RELATED APPLICATIONS

This application claims the benefit of Provisional Application Ser. No. 60/202,523 filed on May 6, 2000.

STATEMENT REGARDING FEDERALLY SPONSORED RESEARCH OR DEVELOPMENT

Not Applicable.

BACKGROUND OF THE INVENTION

1. Technical Field of the Invention

This invention relates to the field of prefabricated wall panels and more particularly to unique panels that include an interior skin profile that provides, through composite action, unique structural capabilities, so as to replace individual structural, insulative and finish elements in a wall. Even more particularly this invention relates to a prefabricated structural panel with a highly insulative foam core bonded to an interior skin of deep ribbed sheet metal with specific characteristics that replace individual structural studs used in conventional construction while also eliminating the undesirable thermal bridging such conventional studs provide and an outer skin or exterior skin which resists impact and contributes to support of live loads.

2. Background of the Invention

The rising cost of labor, equipment and materials has made building construction increasingly more expensive. In addition, the cost of heating and cooling a building has increased substantially over recent years. Due to increased building costs and advances in technology, building owners also have increased expectations for the durability of buildings. In an effort to reduce expensive on-site labor costs the construction industry has increasingly relied on the prefabrication of many components away from the construction site. By prefabricating many of the components at a manufacturing facility many procedures may be used to improve the fabrication efficiencies and quality of the components.

Load bearing prefabricated wall panel components currently in use by the construction industry employ existing technologies including wood, metal, concrete and structural insulated panels with foam plastic cores.

Wood prefabricated load bearing wall panels currently used by the industry are constructed with individual vertical studs of varying depths, widths and thickness, fastened to top and bottom plates with nails or screws. These prefabricated panels are reinforced with outer skins of engineered wood panels, cementitious panels or gypsum drywall panels, fastened with either nails or screws. When delivered to the construction site in this state these prefabricated load bearing wall components are referred to as open panels. Insulation, utilities, interior and exterior finishes are added to these open panels on the construction site. Insulation and interior finishes are sometimes added to the prefabricated panels in the manufacturing facility, in which case these prefabricated load bearing wall components are referred to as closed panels.

Steel prefabricated load bearing wall panels currently used by the industry are constructed with individual vertical studs of varying depths, widths and thickness, fastened to top and bottom plates by screws or welding. These prefabricated panels are reinforced with outer skins of engineered wood panels, cementitious panels, gypsum drywall panels or metal strapping, fastened with screws or welding. When delivered to the construction site in this state these prefabricated load bearing wall components are referred to as open panels. Insulation, utilities, interior and exterior finishes are added to these open panels on the construction site. Insulation and interior finishes are sometimes added to the prefabricated panels in the manufacturing facility, in which case these prefabricated load bearing wall components are referred to as closed panels.

Concrete prefabricated load bearing wall panels currently used by the industry are constructed with individual elements of varying configurations, with a ribbed profile being the most commonly used configuration. These elements are manufactured by casting monolithic components using concrete strengthened with internal metal reinforcing rods or mesh. It is common to incorporate an exterior finish of patterned concrete or stone aggregate into these panels. When delivered to the construction site in this state these prefabricated load bearing wall components are referred to as structural pre-cast concrete elements. Insulation, utilities and interior finishes are added to these pre-cast concrete elements on the construction site.

Prefabricated insulated panels with foam plastic cores currently used by the industry as load-bearing walls are constructed with inner and outer skins of either engineered wood or cementitious sheets adhered to foam plastic cores. These elements are assembled with the use of a separate adhesive in some cases or by use of the foam core material itself as an adhesive. When delivered to the construction site in this state these prefabricated load bearing wall components are referred to as structural insulated panels. It is most common to install utilities, interior and exterior finishes to these panels on the construction site. Though not common, interior and exterior finishes are sometimes installed in the manufacturing facility prior to delivery to the site.

Non-load bearing prefabricated wall panel components currently in use by the construction industry employ existing technologies including steel, concrete and insulated panels with foam plastic cores. These components are generally identified as curtainwalls, and carry only transverse loads.

There are known foam core steel prefabricated curtainwall panels, i.e., non-load bearing panels, currently used by the industry which are constructed with individual vertical studs of varying depths, widths and thickness, fastened to top and bottom plates by screws or welding. These panels have not been considered for use as structure walls because of the deformation that takes place where the temperature difference between the inner and outer wall skins is sufficient to cause deformation of the skins of the panel thereby not worthy of providing axial/dead load carrying capabilities. These prefabricated panels are reinforced with outer skins of engineered wood panels, cementitious panels, gypsum drywall panels or metal strapping, fastened with screws or welding. When delivered to the construction site in this state these curtainwall components are referred to as open panels. Insulation, utilities, interior and exterior finishes are added to these open panels on the construction site.

Concrete curtainwall panels currently used by the industry are constructed with individual elements of varying configurations. These elements are manufactured by casting monolithic components using concrete strengthened with internal metal reinforcing rods or mesh. It is common to incorporate an exterior finish of patterned concrete or stone aggregate into these panels. When delivered to the construction site in this state these curtainwall components are referred to as structural pre-cast concrete elements. Insulation, utilities and interior finishes are added to these pre-cast concrete elements on the construction site.

Prefabricated insulated panels with foam plastic cores currently used by the industry as curtainwall components are constructed with inner and outer skins of painted ribbed, smooth or patterned metal. These elements are assembled with the use of a separate adhesive in some cases or by use of the foam core material itself as an adhesive. When delivered to the construction site in this state these prefabricated curtainwall components are referred to as insulated metal curtainwall panels. The painted exterior skin of these panels is commonly used as an exterior finish material. It is most common to install utilities, interior finishes and sometimes additional insulation to these panels on the construction site.

Load bearing prefabricated wall panel components currently in use by the construction industry rely on existing technologies when using wood, metal or concrete materials. The method of construction for these panels in the manufacturing facility is substantially the same as if these components were constructed in the field, with the only advantages offered by prefabrication being convenient and predictable working environments and varying levels of automation to reduce manual labor. Substantial work at the construction site is still required with these systems for the installation of insulation, interior and exterior finishes. In addition, each of these systems relies on structural elements that provide substantial thermal bridges resulting in excessive energy consumption and excessive movement of individual building elements over time.

Prefabricated insulated panels with foam plastic cores currently used by the industry are the result of manufacturing processes that cannot be duplicated on a construction site, and the more or less continuous nature or characteristic of such panels minimizes the thermal bridging and excessive movement common to other types of prefabricated wall systems. Due to the skin materials and profiles these prefabricated insulated panels require that loads, more specifically dead loads or so-called axial loads, be transferred to both inside and outside skins in generally equal proportions. Also due to the skin materials and profiles there are specific limitations on the combined transverse and axial loads such panels can take.

It would be advantageous to provide a load bearing prefabricated insulative wall panel with a plastic foam core that would carry loads through a ribbed metal interior skin. It would also be advantageous to provide such a panel as a structural panel which is able to carry axial/dead load substantially by the inner skin irrespective of the temperature ($\Delta T$) between the inside and the outside skins of the panel. The thickness and profile of the interior ribbed metal skin could be varied depending on the load to be carried and the height of the load bearing wall. Such a load-bearing prefabricated insulative panel would offer ease of manufacture, efficient use of materials through composite structural action, superior thermal performance through the elimination of thermal bridging, design flexibility through the thickness and profile variation of the interior metal skin and simplified installation due to the axial load carrying capability of the interior skin without the need for axial load carrying by an outer skin.

SUMMARY OF THE INVENTION

The present invention, in its most simple embodiment, is directed to a prefabricated insulated structural panel, having a core material of various types of foam plastic bonded to an interior ribbed metal skin and an exterior skin of any one or combination of suitable exterior materials such as for example wood, fiber glass, cement, or metal. The basic geometry for the combination of the core and skin is preferably, but not necessarily basically rectangular in shape. The edges of the panels are configured to abuttingly match corresponding edges of similarly configured panels when such panels are arranged in edge to edge relationship to form the structure wall of a building. The interior ribbed metal skin, when bonded to and foam backed—where the foam is continuous and flows completely into the cavities or the valleys of the outward facing side as compared to the interiorly facing side of the ribbed panel—and an outward skin bonded to the outer surface of the foam core, all combine to form a structural panel in which the ribbed inner skin will support substantially the entire axial load and the composite panel will support all the live or wind load to which it would be subjected.

A fundamental objective of the invention is to provide prefabricated structural building panels wherein the interior ribbed metal skin, reinforced by the foam plastic core, carries axial loads from building elements such as roof decks, floor systems and/or other individual structural elements such as beams or joists.

A further objective of the invention is to provide prefabricated structural building panels with exterior skins of varying materials serving as exterior finishes or substrate for the application of exterior finishes, and in conjunction with the interior ribbed metal skin and plastic foam core provides a composite structure capable also supporting transverse loads.

A further objective of the invention is to provide prefabricated structural building panels capable of substantially reducing thermal bridging through the use of a continuous plastic foam core.

A further objective of the invention is to provide prefabricated structural building panels that can be tailored to carry specific axial loads through the modification of the thickness of the metal, the spacing from rib-to-rib, and configuration of the ribs of the interior metal skin. The present invention integrates each of these objectives into an invention whose benefits will become apparent to those skilled in the art after a study of the present disclosure of the invention.

BRIEF DESCRIPTION OF THE SEVERAL VIEWS OF THE DRAWING

For a more complete understanding of the present invention and for further features and advantages, reference is now made to the following description taken in conjunction with the accompanying drawings, in which:

FIG. 1 is a section view of an insulated metal panel showing in particular the foamed core, the thickness of foam, the size of the ribs, and the exterior skin.

FIG. 1A is a section view of the insulated deep ribbed metal skin composite structural panel of the present invention with rib dimensions different from the rib dimensions shown in FIG. 1 illustrating thereby one aspect of the design variability of the invention.

FIG. 5 is a perspective view of a possible slotted rib embodiment, which slots may be used to direct wiring, piping and the like.

DETAILED DESCRIPTION OF THE INVENTION

Prior art structural panels that were both transversely and axially load-bearing have typically been constructed from either separate components that were joined in various ways or by reinforcing cementitious material. The prefabricated walls created in such a way were subject to thermal bridging, were inefficient to fabricate, and cumbersome to install. The present invention, in its most simple embodiment, overcomes these difficulties as follows. To overcome the thermal bridging problem, the typical stud construction, where the variation in thermal conductivity through the cross-section causes thermal bridging, is replaced by a solid fabricated ribbed structure with uniform thermal conductivity through the cross-section. In terms of fabrication, the present invention can be constructed through pouring materials into shaped molds with no fastening of components or reinforcing required. And finally in terms of installation, since the panels are completely constructed walls, no studding is required. In addition, the panels can connect to each other in many simple and durable ways. In summary, ribs that are filled with foam and are integral parts of the panel work to tie everything together to create a strong stress-skin panel. Tons of dead (axial) load can be born completely by the deep-ribbed metal skin, because the composite construction protects the wall from buckling and other stress-related failures.

Figure 6:
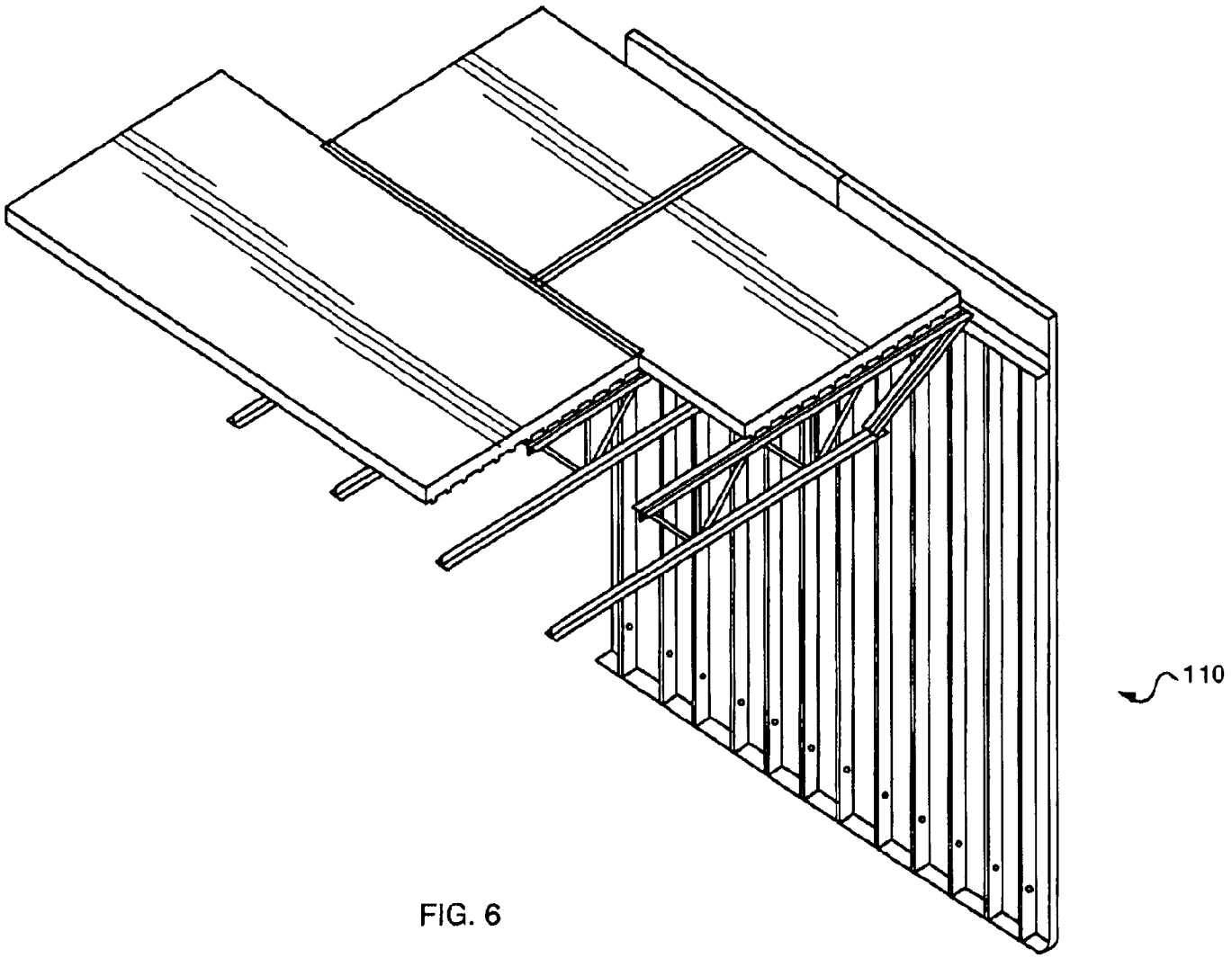
FIG. 6 is a portion of a structure illustrating the use of the insulated deep ribbed metal skin composite structural panel of the present invention showing the axial loading on the inner skin and illustrating apertures directed transversely through the ribs which may be used to route utilities and which may be used in joining of panels in edge to edge relationship to form the building wall.

The basic invention is meant to look, in cross-sectional view, as depicted in FIG. 1. Referring to FIGS. 1 and 1A, interior metal skin 116 can be constructed of any thickness and material. The interior metal skin 116 is prefabricated in the shape of spaced apart ribs 101 or 101' separated by the field region 102 or 102' and will be the structural replacement for prior art studding when combined with the foam core 112 with a rib portion of foam 114 of foam core 112. Foam completely fills the ribs and creates a composite structural panel 100 or 100' (see also FIG. 6) Completely filling the interior of the metal-skinned ribs and bound to them, is foam material 114 which can be composed of any material commonly known in the art to be used for such a purpose. In the preferred embodiment, this material should withstand high temperature exposure without breakdown in order for the wall to remain structurally sound under all temperature conditions. Layered on the ribbed metal skin is a variable-thickness core 112 composed of the same material 114 used to fill the ribs. The thickness of this foam core can be adjusted to accommodate various structural, construction, and load-bearing requirements of the panel. Layered on top of the foam core, and securely bonded thereto is an exterior wall 110 composed of material such as a fiberglass sheet that is fixedly bonded to the foam core. This exterior wall or skin 110 may also be of varying thickness and material to accommodate structural, construction, and load-bearing requirements.

Figure 2:
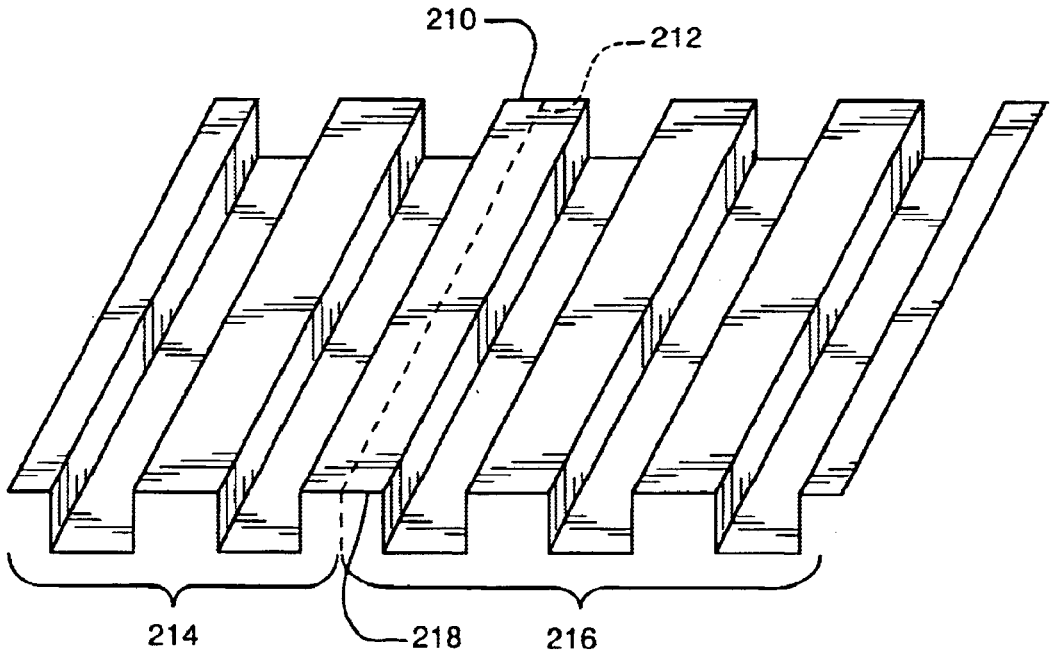
FIG. 2 is a perspective view of two insulated metal panels at their joint.

Panels disclosed herein can be fabricated of any rectangular size. In the preferred embodiment, panel edges that are parallel to the orientation of the ribs are meant to terminate mid-rib, as shown in FIG. 2, the perspective depiction of construction using two panels. Referring now to FIG. 2, the left panel 214 that is terminated with a half-rib 210 is joined to the right panel 216 at its edge half-rib 218 at the common interface of the panels 212. The panels can be joined in one of many ways, a subset of these being depicted in FIGS. 3*a–d*. This type of joint provides for uniform load-bearing capacity because the structure effectively becomes a single solid wall after joining the panels. However, the panels remain easy to transport and manipulate because their rectangular sizes can be adjusted to accommodate the requirements of the construction job site without compromising their load-bearing properties that are based on the rib geometry, the interior ribbed skin thickness, the foam core material and thickness and the exterior.

Figure 3A:
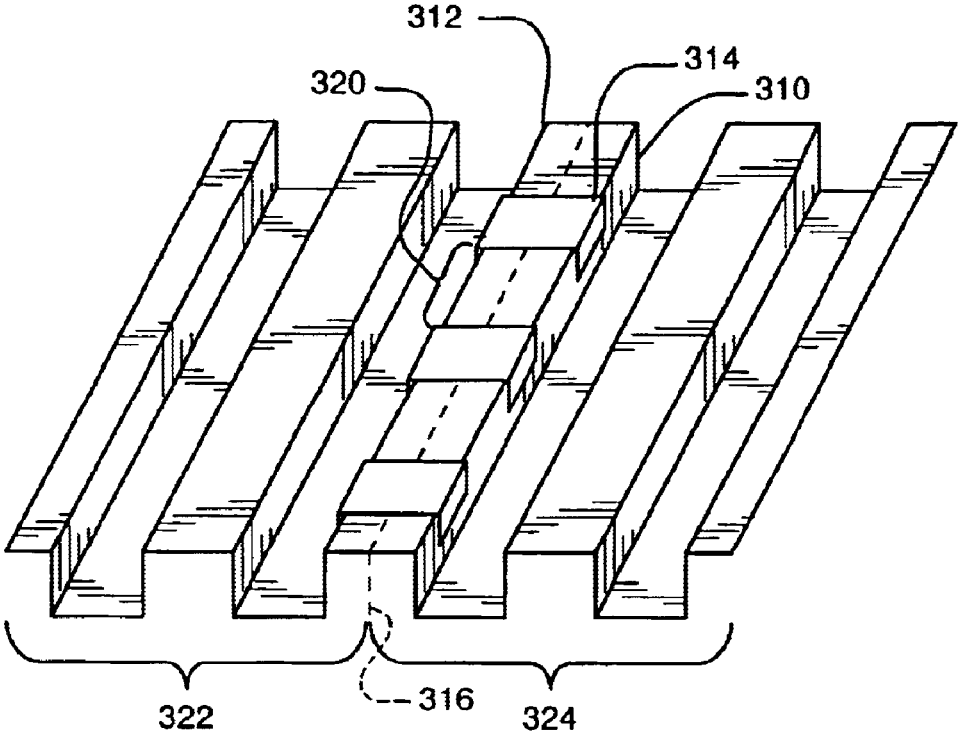
FIGS. 3*a–d* illustrate various types of joints that continue the panel strength through the joint itself.

In preferred embodiments, panels are joined in any of the following example manners. Some of the ways for joining panels of the invention are: use of appropriately sized nuts and bolts, capping, ramlock, adjustable grommet, and ram lock tube. Referring now to FIG. 3*a*, for a particular construction project, panels might be joined by capping the half-ribs with fabricated rib caps 314 at, in the preferred embodiment, regular intervals 320 along the joint 31 of the two panels. In this case, the left half-rib 312 that represents the edge of the left panel 322 is abutted against the right half-rib 310 that represents the edge of the right panel 324 and the two halves which form a flush, complete rib are capped 314 to hold the panels together. The caps 314 can be constructed of any material commonly used for such a function and known in the art. It is also important to note that caps 314, rather than being small individual caps could well be and would preferably be caps 314 that would extend for the length of the ribs being joined. I.e. it is not critical that caps 314 be short sections, they could well be one long section which caps the joined ribs from the top of the panel to the bottom of the panel.

Figure 3B:
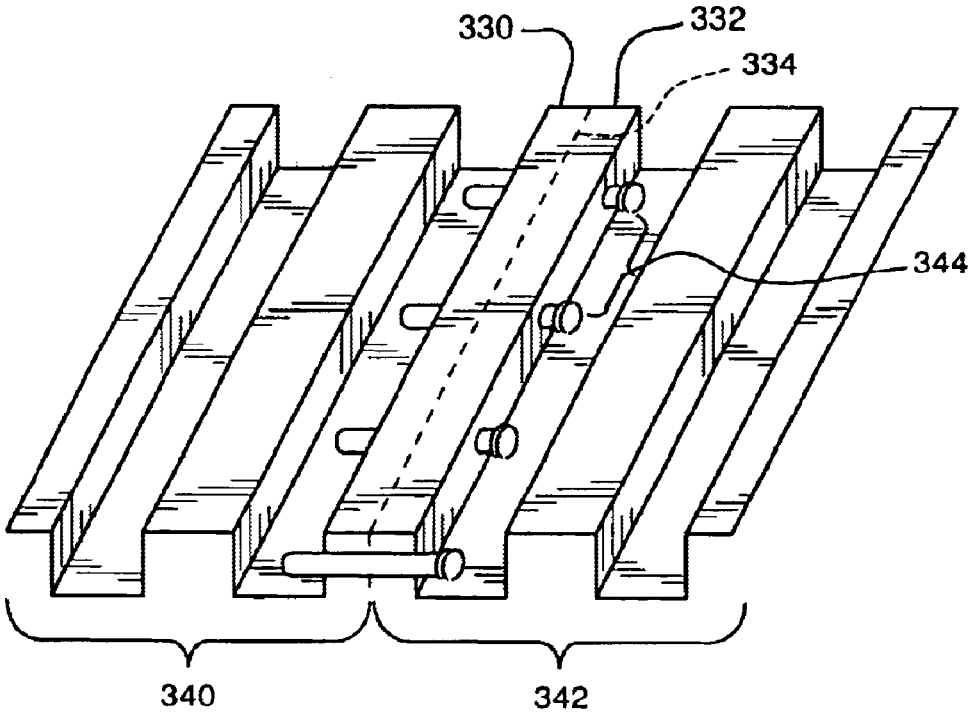

As used in Applicant's invention, a ramlock device 336 consists of two interacting components, a coupling or nut component and a thread component. They are not separately shown in the Figures, but rather are shown in a joined state, connecting adjacent panels. The thread component has male threads on a thread end which threads match female threads on the coupling or nut component. A ramlock may be inserted a chosen positions or intervals, as shown in FIG. 3*b* through the foam core essentially perpendicular to the long axis of the ribs. Each panel will have one coupling component and one thread component therethrough with the coupling components located along one edge of the panel and the thread component located along the opposite edge. When joined, panels are aligned such that a row of coupling components on one panel faces row of threaded components on an adjacent panel. Force is then applied to push the panels together such that the thread components of one panel enter and engage the coupling component of the adjacent panel, thereby locking the panels together.

Ramlock tubes 388 are simply a variation in which a continuous tube is inserted through the foam core to connect adjacent panels and is secured at the end of the finished building panel.

Figure 3C:
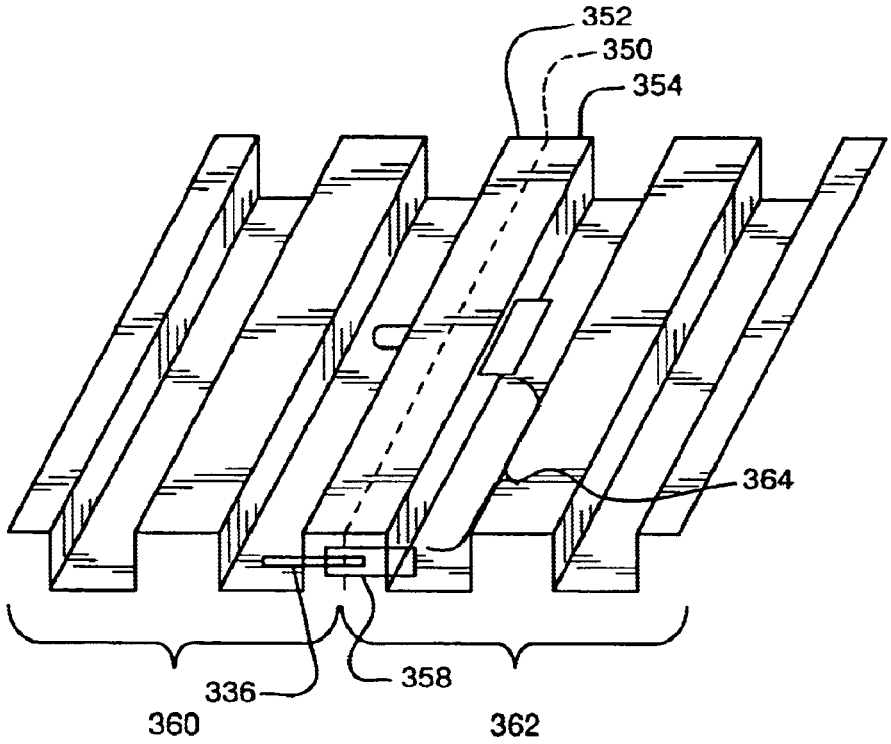

As used in Applicant's invention, the term grommet can also be termed cam-lock, as shown in FIG. 3*c* in which a coupling component and a cam component are inserted through the foam core of a panel, and a cooperating cam component on one panel engages with a cooperating coupling component in an adjacent panel, wherein a hook portion of the cam component engages with a latch portion such that once engaged and rotated such that the hook portion engages latch portion, they can not be pulled apart linearly.

A more detailed explanation of the ramlock and rotatable grommet connection devices can be found in Applicant's U.S. Pat. No. 5,471,804, starting at Column 18, which is incorporated herein by reference in its entirety.

FIG. 3*b* depicts the left panel 340 being joined at its half-rib 330 to the right panel 342 at its half-rib 332 via one or more ramlocks 336 at the joint 334. If more than one ramlock 336 is used, in the preferred embodiment they are placed at regularly-spaced intervals 344 along the joint 334. The ramlock 336 can be constructed in any way commonly known in the art, and in the preferred embodiment is a bolt mechanism.

Another connection mechanism is the adjustable grommet 356/358 depicted in FIG. 3*c*. As in other connection mechanisms, the left panel 360 is connected at its half-rib edge 352 to the right panel 362 at its half-rib edge 354 via the adjustable grommet 356 at the joint 350. As before, in the preferred embodiment, the adjustable grommets 356/358 are positioned at regular intervals 364 along the rib. The adjustable grommet 356/358 can be constructed in any way commonly known and used in the art.

Figure 3D:
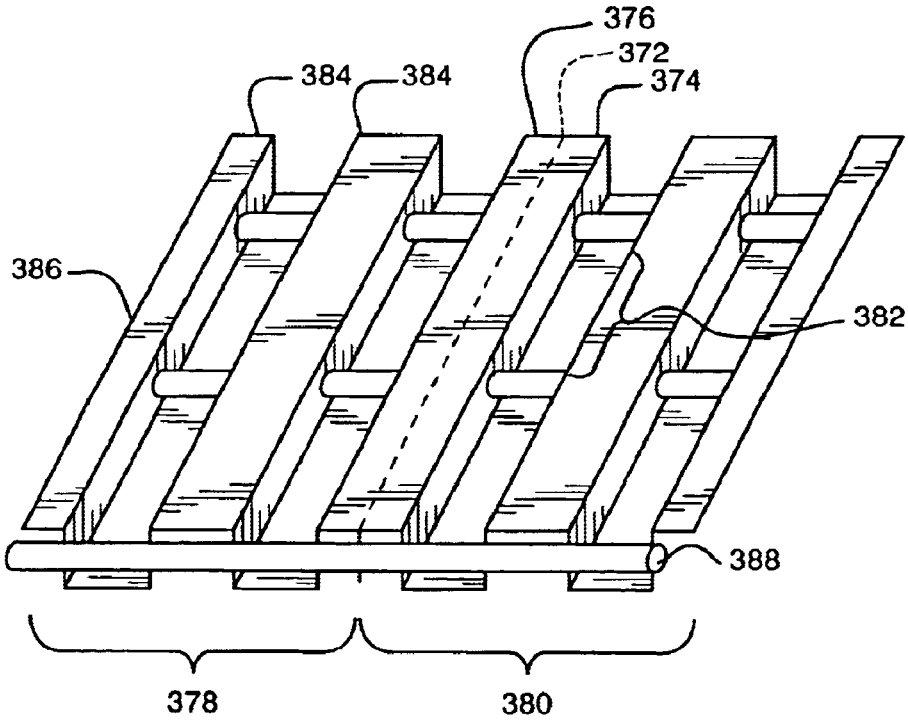

An additional connection mechanism, providing extreme structural reinforcement, is the ramlock tube 388 depicted in FIG. 3*d*. As in previous connection devices, the left panel 378 is connected at is half-rib edge 376 to the right panel 380 at its half-rib edge 374 via the ramlock tube 388 at the joint 372. The ramlock tube 388 extends through multiple ribs 384, not the single rib interface as in the ramlock 336. In the preferred embodiment, the ramlock tube extends at least the width of the panel through each rib from panel outer edge 386 to panel inner edge at the joint 372 and through another panel's half-rib 374. As before, in the preferred embodiment, ramlock tubes 388 can be positioned at regular intervals 382 along the joint 372. The ramlock tube 388 can be constructed of any material commonly used in the art for such a purpose.

While it is not essential, where the panels 100' are relatively large and are designed for substantial load bearing capability, (see FIG. 1A) it is desirable to securely affix with, for example welds 116D, rib bridging elements 116B which bridge each of ribs 101' of the ribbed interior skin 116 along horizontal positions corresponding to the positions of joining apertures 116C such as shown in FIG. 1A which may provide the means used to affix adjacent panels in edge to edge relationship to form the structural wall of the building. These rib bridging elements 116B keep ribs 101' from expanding in an according fashion when panels such as 100' are drawn tightly together at the joining edges of half-ribs 101'A using any of the joining methods such as bolts and nuts through joining apertures 116C through half-rib 101'A. It is important to not allow the ribbed inner sheet metal skin 116 to flex or separate from the secure bonding to the foam core. Rib bridging elements 116B, for example welded by welds 116D across ribs 101' and subsequently enclosed by the foam core 112 and 114, provides the structure needed to keep the ribs from expanding and separating from the foam. The rib stiffening, i.e., rib bridging elements are shown in the drawing FIG. 1A and are desireable elements especially for structural walls required to bear large dead or axial loads.

Figure 4:
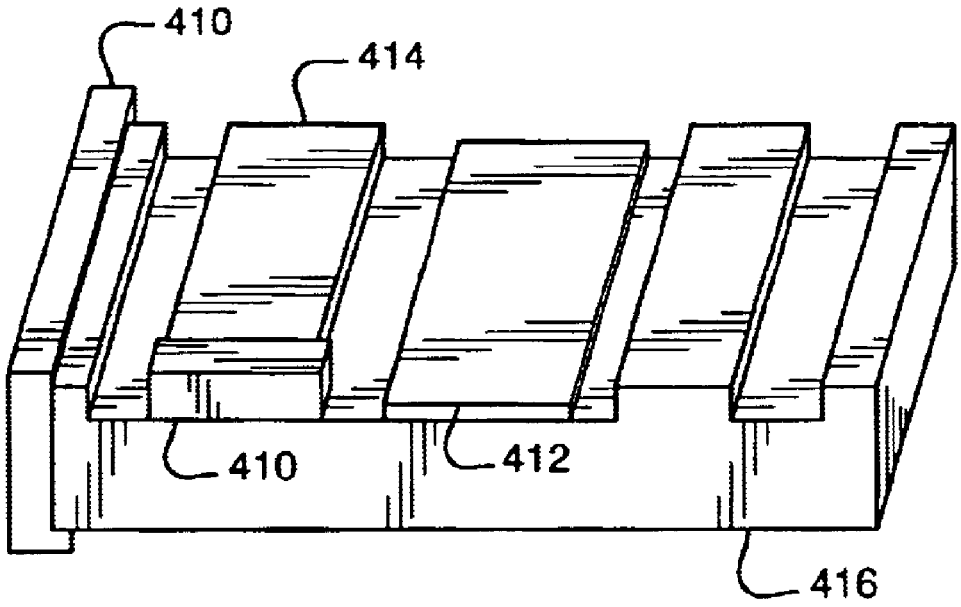
FIG. 4 is a perspective view of various forms which may be used for the capping of the bottom, the top and the edges of the structural panel of the invention.

Referring now to FIG. 4, for protection of the foam core and rib foam at panel edges that do not abut other panels, a cap 410 is disclosed and composed of any material commonly used for such a purpose and appropriate to the particular construction project. The cap 410 is fabricated in a shape meant to cover an edge of a panel that is not already covered by either the metal skin that forms the ribs 414 or the fabricated sheet attached to the foam core 416. In addition, on-site removal of the ribs might be required in order to adapt a panel to a particular construction project. In this case, a lengthwise rib cap 412 is disclosed and meant to protect the core foam from damage during and after installation. Again, the cap 412 is constructed of materials commonly used for such a purpose, and fabricated in the shape to accommodate the space where a rib would have been.

Figure 5:
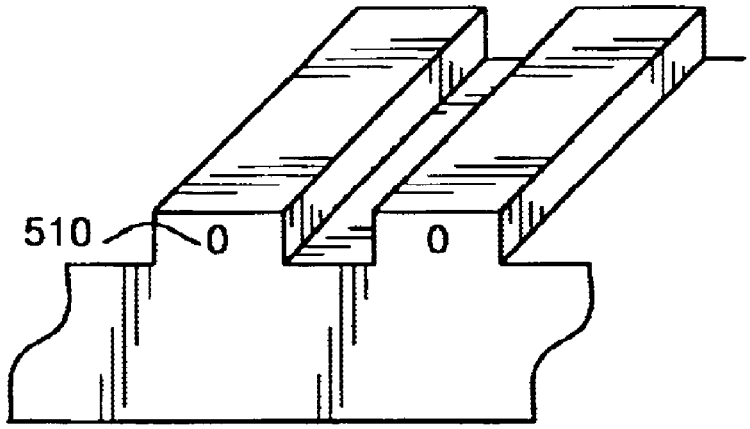

Referring now to FIG. 5, in the preferred embodiment, the ribs are fabricated such that there is a pointed ovular-shaped slot 510 that could, but doesn't have to, extend through the core of the rib and is meant to accept connective devices for other parts of the construction project such as devices for attachment of roofing structures.

It is thought that the present invention, a load bearing prefabricated insulative wall panel with a plastic foam core that would carry loads through a ribbed metal interior skin, and many of its attendant advantages is understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

I claim:

1. A prefabricated, structural wall system comprising:

At least two connectable prefabricated structural load bearing wall panels, each comprising:

A ribbed interior axial load-bearing skin having a predetermined thickness, two opposed and substantially parallel side edges each of which terminates at the midpoint half the width of a rib peak, and an opposed and substantially parallel top and bottom edges;

A flat exterior kin having a predetermined thickness sized substantially the same as said interior skin; and A stiffening core of predetermined thickness sized substantially the same as said interior skin and said exterior skin, said core having two opposing surfaces; one said surface shaped to fit within the ribs of said ribbed interior skin, and securely affixed to said ribbed interior skin; and one said surface shaped substantially flat, and securely affixed to said flat exterior skin, thereby forming a unitary load bearing wall panel; wherein said core comprises least one slot cut through said core and running through said core along the length of at least one said rib; and At least one panel fastening means comprising a capping means or a ramlock tube means, that join said wall panels each to the other when placed side to side such that said mid-rib terminated side edges of adjacent said wall panels form a single complete rib peak having a longitudinal non-overlapping seam.

2. The wall system according to claim 1 wherein said ribbed interior axial load bearing skin is metal material.

3. The wall system according to claim 1 wherein said exterior skin is fiberglass sheet material.

4. The wall system according to claim 1 wherein said stiffening core is foam material.

5. The system of claim 1 wherein at least one said capping means is affixed and secured over each newly formed said single rib, to join said wall panels together.

6. The system of claim 5 comprising multiple said capping means affixed at chosen intervals along each said single rib.

7. The system of claim 1 wherein at least one ramlock tube means is inserted from a side of a said wall panel through said core of said wall panel, and into and through said core of at least one adjacent said wall panel, thus joining one or more adjacent said wall panels.

8. The system of claim 7 comprising multiple said ramlock tube means inserted at intervals through said adjacent wall panels.

9. The system of claim 1 wherein said fastening means comprises at least one ramlock bolting device inserted through each newly formed said single rib to join adjacent said wall panels.

10. The system of claim 1 wherein said fastening means comprises at least one adjustable gromment device secured through each newly formed said single rib to join adjacent said wall panels.

* * * * *